US006175102B1

(12) United States Patent
Stedron et al.

(10) Patent No.: US 6,175,102 B1
(45) Date of Patent: Jan. 16, 2001

(54) HOLDER FOR A HOT PLATE

(75) Inventors: Horst Stedron, Herborn; Peter Nass, Mainz; Ulrike Bader, Stuttgart; Bernd Schultheis, Schwabenheim, all of (DE)

(73) Assignees: Schott Glas, Mainz; LKH Kunststoffwerk GmbH & Co. KG, Haiger, both of (DE)

( * ) Notice: Under 35 U.S.C. 154(b), the term of this patent shall be extended for 0 days.

(21) Appl. No.: 09/147,869

(22) PCT Filed: Aug. 18, 1997

(86) PCT No.: PCT/EP97/04507

§ 371 Date: Jun. 1, 1999

§ 102(e) Date: Jun. 1, 1999

(87) PCT Pub. No.: WO98/12482

PCT Pub. Date: Mar. 26, 1998

(30) Foreign Application Priority Data

Sep. 17, 1919 (DE) ..... 096370784.6

(51) Int. Cl.[7] ..... H05B 3/68; F24C 15/10

(52) U.S. Cl. ..... 219/452.11; 126/211

(58) Field of Search ..... 219/451.1, 452.11, 219/452.12, 460.1, 465.1; 126/211, 217, 218, 214 A

(56) References Cited

U.S. PATENT DOCUMENTS 3,866,018 * 2/1975 Hurko ..... 219/465.1
4,453,533 6/1984 Scheidler et al. .
5,399,839 * 3/1995 Taplan et al. ..... 219/452.11
5,841,109 * 11/1998 White et al. ..... 219/452.12
5,844,206 * 12/1998 Steiner et al. ..... 219/452.12

FOREIGN PATENT DOCUMENTS 33 37 148 A1 4/1985 (DE) .
40 04 093 A1 8/1991 (DE) .
0 391 122 A2 3/1990 (EP) .
86 14531 10/1986 (FR) .
2 090 399 7/1982 (GB) .

OTHER PUBLICATIONS

Abstract of JP 63–194131 A (Matsushita Electric Ind Co. Ltd.—Aug. 11, 1988.

* cited by examiner

*Primary Examiner*—Sang Paik
(74) *Attorney, Agent, or Firm*—Jansson, Shupe, Bridge & Munger, Ltd.

(57) ABSTRACT

A mounting arrangement for a cooking surface is provided. The mounting arrangement is mounted in a cut-out of a work plate in the top of a kitchen range. The mounting arrangement includes a one-piece frame connected to an assembly unit to form a sub-assembly. The cooking surface is supported on a supporting section of either one of the frame or the assembly unit. The frame can be joined to the assembly unit in a simple manner by providing catch projections and catch receptacles on both the frame and the assembly unit in order to form a catch connection. The frame and the assembly unit form a one-piece sub-assembly, being connected to each other via the catch connection formed by the catch projections and catch receptacles.

6 Claims, 2 Drawing Sheets

HOLDER FOR A HOT PLATE

RELATED APPLICATION AND CLAIM OF PRIORITY

This application is a national application of PCT Application No. PCT/EP97/04507 having an international filing date of Aug. 18, 1997, which designates at least one country in addition to the United States and which claims priority from German Application No. 196 37 784.6 filed Sep. 17, 1996. For priority purposes, this application continues the above-noted PCT application and claims the benefit of 35 USC 371 and/or 35 USC 120.

BACKGROUND OF THE INVENTION

1. Field of the Invention

The present invention generally relates to a mounting arrangement for a cooking surface and more particularly, to a mounting arrangement for a cooking surface, wherein the cooking surface is to be installed in a cut-out in a work plate using a frame and an assembly unit, wherein the cooking surface is supported by a support section of either the frame or the assembly unit, wherein the frame is a one-piece unit which is connected to the assembly unit, and wherein each of the frame and the assembly unit have mutually allocated locking projections and locking recesses for forming a locking connection to connect the frame and the assembly unit into a sub-assembly.

2. Description of the Related Art

One type of mounting arrangement for a cooking surface is known from DE 40 04 093 (hereinafter DE '093). In the type of mounting arrangements taught in DE '093, the assembly unit has a flange that projects outwardly and is supported in the surface of the work plate. The assembly unit itself serves to receive and shield the heating elements that are arranged beneath the cooking surface. The cooking surface is constructed as a glass-ceramic plate. A frame is used to support and fix the cooking surface. The frame includes a shoulder with a circumscribing horizontal support section. The cooking surface has an edge area which can be placed on the support section and can be fixed to the support section by using a silicone adhesive in a material-locking manner. Locking connections are provided to connect the frame to the assembly unit. These types of mounting arrangements can become costly because of the assembly work needed to adhere the cooking surface to the frame.

Another type of mounting arrangement is known from EP 03 91 122 (hereinafter EP '122). In this type of mounting arrangement, a frame is normally built and assembled using four legs therefor in order to fix the cooking surface to the work plate. The legs of the frame include a plug receptacle. The plug receptacle has a support section and a cover section. The cover section is parallel to and at a distance from the support section. Each of the legs of the frame, including their plug receptacle, slide onto the edge of the cooking surface. Thus, the underside of the cooking surface comes into contact with the top of the support section. The cover section overlaps the cooking surface at the top of the area near the edge of the cooking surface. The individual legs of the frame form a closed frame around the cooking surface. The frame, thus-configured, has a flange which projects outwardly, and which lies on another flange of the assembly unit. The flange of the assembly unit has a tub-shaped base body into which electronic components can be arranged under the cooking surface. Fastening receptacles are recessed into the assembly unit in order to connect the frame to the assembly unit. These fastening receptacles must be aligned with the appropriate threads in the frame so that the frame can be screwed onto the assembly unit.

A mounting apparatus such as taught in EP '122 requires costly assembly work. Also, the assembly unit is often not precisely aligned with respect to the cooking surface because of the tolerances between the screws and the fastening receptacles. Thus, the heating elements are not exactly arranged at the intended positions on the underside of the cooking surface.

An object of the present invention is to provide a mounting arrangement of the type taught in EP '122, but forming a secure attachment of the cooking surface with as little costs for assembly and parts as possible.

The above-described object is accomplished according to the present invention by having the cooking surface clamped and sealed between the frame and the assembly unit so that the cooking surface is connected to the mounting arrangement in a simple manner during an assembly step of joining the frame to the assembly unit. In this way, the sealing of the cooking surface to the mounting arrangement is also reliably accomplished at the same time.

SUMMARY OF THE INVENTION

According to one advantageous design of the present invention, the assembly unit includes a receptacle into which the cooking surface is placed. The frame has a cross-piece that overlaps the frame area of the cooking surface so that the cross-piece forms a downwardly directed leg that is supported on the cooking surface. The edge area of the cooking surface is covered by the receptacle and the cross-piece so that the edge area is no longer accessible from the outside. In this way, there is little chance of damage to the cooking surfaces which are generally made of glass ceramics.

The cross-piece that is supported on the cooking surface stops dirt from penetrating into the area between the outer face of the cooking surface and the frame. In this case, the cross-piece can, for example, include a sealing lip. If the frame is produced using a plastic injection molding process, then the sealing lip can be sprayed on.

One variation on the design of the present invention described above provides that in order to fix the mounting arrangement to the work plate, one support part is connected to the cross-piece of the frame and is set on the surface of the work plate. The support part holds the cross-piece at a distance from the surface of the work plate. Then, an adhesive material is applied in the area between the cross-piece and the work plate. The cross piece and the support part form a receiving space for the adhesive layer. The adhesive layer can simultaneously also serve as a sealing element, in which case, a silicone adhesive would be used as the adhesive layer.

The locking connection of the frame to the assembly unit is possible, in part, because the frame includes a locking projection that is provided with an oblique deflection part, because the assembly unit has an edge that extends at a distance from the work surface, and because the locking projection passes through the free space formed between the work plate and the edge and engages, behind the edge, with a locking recess that has been formed as an undercut. The assembly unit and the frame can thus be pre-assembled into a sub-assembly and the sub-assembly can then be positioned in the cut-out in the work plate. Thus, the distance from the locking projection to the work plate is less than the deflection distance required for the engagement between the locking recess and the locking projection. In this way, the locking connection can no longer be loosened when the mounting arrangement is mounted in the cut-out.

DETAILED DESCRIPTION OF THE INVENTION

Figure 1:
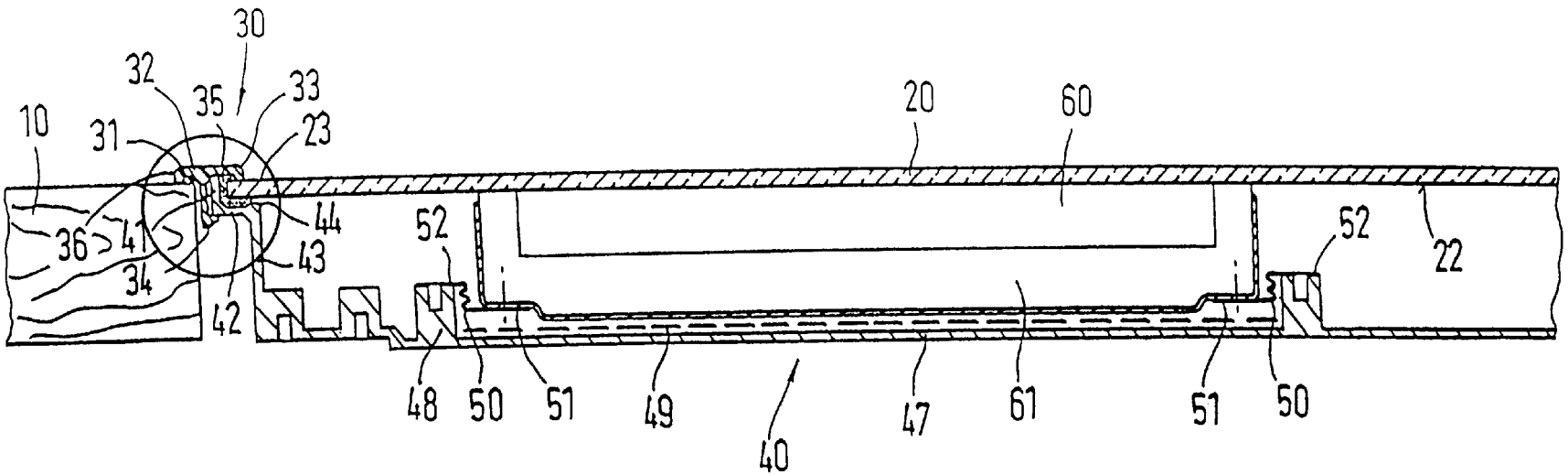
FIG. 1 is a lateral elevational and cross-sectional view of the mounting arrangement for the cooking surface of the present invention.
Figure 2:
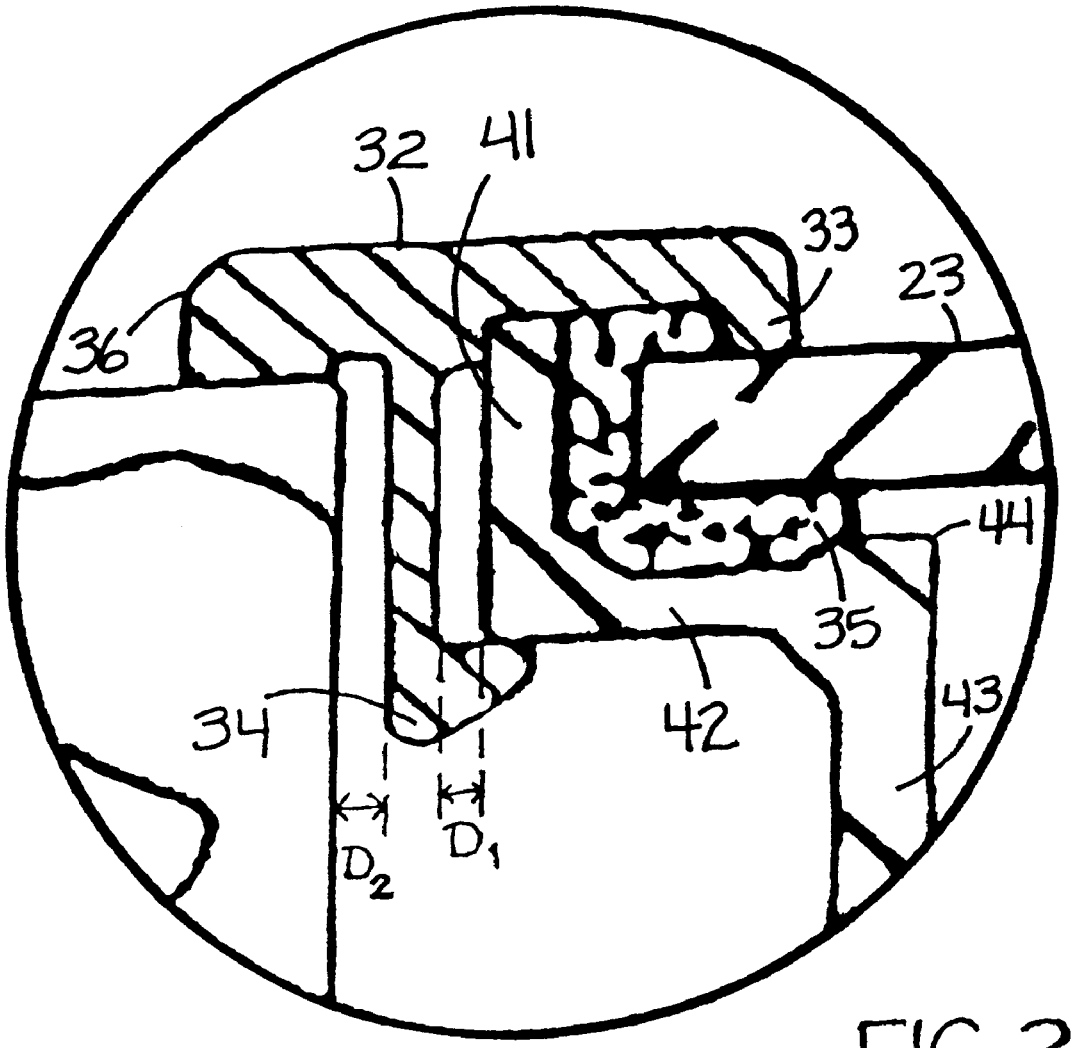
FIG. 2 is a lateral elevation sectional view of the mounting frame showing the distance between the end of the projection and the edge of the assembly unit and the distance between the locking the end of the work plate.

The present invention will be explained in more detail below based upon an exemplified embodiment represented in the drawing.

Referring to FIG. 1, part of a work plate 10 is shown. The work plate 10 is provided with a cut-out therein. A cooking surface 20 is to be placed within the cut-out and supported therein by a mounting arrangement. The mounting arrangement includes a frame 30 and an assembly unit 40. The frame 30 is a one-piece unit and is connected to the assembly unit 40. The assembly unit 40 has a support section 23 on which the cooking surface 20 is to be supported within the cut-out in the work plate 10.

The assembly unit 40 is tub-shaped in design and includes a floor unit 47 and a circumscribing wall 43. The circumscribing wall 43 is connected to the floor unit 47. The floor unit 47 includes fastening parts 48. The fastening parts 48 project into the space within the assembly unit 40. Springs 50 are connected to the fastening parts 48 and the springs 50 extend outwardly. The springs 50 include fastening sections 52 connected to the fastening parts 48. Furthermore, the springs 50 include a support section 51. This support section 51 supports a receptacle body 61. One or more heating elements 60 can be placed in the receptacle body 61 to be supported on the fastening parts 48. A plurality of springs 50 are connected to the floor unit 47, depending on the size of the receptacle body 61.

The heating elements 60 are pressed or spring-biased to the underside 22 of a cooking surface 20 via the springs 50. The cooking surface 20 can, for example, be constructed as a glass ceramic cooking field. The cooking surface 20 has an end edge area with a supported section which lies on an outwardly directed flange of the assembly unit 40. The flange extends outwardly perpendicular to the wall 43 and all of the way to edge 41 of the assembly unit 40. The flange and the wall 43 together form a receptacle for the end edge of the cooking surface 20. A gasket 35 is used to seal the cooking surface 20 by being fitted to the underside 22, the side and the upper side of the cooking surface 20. A silicone adhesive can, for example, be used as the seal in place of the gasket 35. It is also possible that a foam sealing bead, in the form of a polyurethane, can be foamed into the receptacle to form the end edge of the cooking surface 20. As can be seen in FIG. 1, the wall 43 overlaps the flange to some extent to create a projection 44. The gasket 35 is thereby held between the projection 44 and the edge 41 of the assembly unit 40.

The frame 30 is used to connect the assembly unit 40 to the work plate 10. The frame 30 is essentially T-shaped in cross-section and is manufactured using a single piece of plastic to form a one-piece unit. The frame 30 has a horizontal cross-piece 32 that projects over the upper side of the cooking surface 20 and the work plate 10. A locking projection 34 is connected to the cross-piece 32. The locking projection 34 passes between the work plate 10 and the end edge of the cooking surface 20 and engages in an undercut of the flange which is designed as a locking recess 42. Preferably, a plurality of locking projections 34 are formed on the frame 30 so as to be distributed along the circumference thereof.

Indeed, both the frame 30 and the assembly unit 40 each include locking projections 34 and locking recesses 42 which complementarily mate with each other in order to form a locking connection to connect the frame 30 and the assembly unit 40. The locking connection serves to hold the cooking surface 20 clamped and sealed between the frame 30 and the assembly unit 40. At least one of the locking projections 34 of the frame 30 includes a deflection or support part 36.

The deflection or support part 36 is connected to the cross-piece 32 which is supported on the upper side of the work plate 10. The support part 36 holds the cross-piece 32 so that it is at a distance from the work plate 10. A free space is thereby formed between the work plate 10 and the cross-piece 32. An adhesive layer is applied in this free space. The adhesive layer acts to connect the work plate 10 to the mounting arrangement.

A leg 33 is formed on the end of the cross-piece 32 which faces the cooking surface 20. This leg 33 is supported on the upper side of the cooking surface 20. The leg 33 allows the cross-piece 32 to be at a distance from the upper side of the cooking surface 20. In this way, another receptacle space is created for the gasket 35. The leg 33 itself can assume a sealing function if it has an appropriate design. For example, it is possible for the leg 33 to extend into a sealing lip which contacts the cooking surface 20. However, it is also possible to form the leg 33 using a soft plastic. In this case, the leg 33 can be sprayed onto the cross-piece 32.

First, the assembly unit 40 is equipped with the heating elements 60 in order to assemble the mounting arrangement. The cooking surface 20 can then be positioned on the heating elements 60 and the frame 30 can be engaged. The cooking surface 20 is thereby pressed or spring-biased into the receptacle in the assembly unit 40. The sub-assembly formed from the frame 30 and the assembly unit 40 can be positioned as a one-piece component in the cut-out of the work plate 20 and can be fixed therein using the adhesive 31.

The frame 30 and the assembly unit 40 are each preferably manufactured from a suitable plastic material such as any one of duroplastic, thermoplastic, or a plastic composite material.

What is claimed is:

1. A mounting arrangement for a cooking surface, wherein the cooking surface is to be installed in a cut-out in a work plate using a frame and an assembly unit so that the cooking surface is supported on a support section of the assembly unit, the frame is a one-piece unit that is connected to the assembly unit, and the frame and the assembly unit each include mutually allocated locking projections and locking recesses in order for the frame and the assembly unit to be engaged with each other as one sub-assembly, the mounting arrangement comprising:

the locking projections each having a first end proximate the assembly unit and a second end proximate the work plate with the first end separated from the edge of the assembly unit by a first distance;

at least one of the locking projections of the frame having a deflection part;

the assembly unit having an edge extending at a distance from the work plate such that the locking projection passes through a free space formed between the work plate and the edge of the assembly unit to engage in a locking recess formed as an undercut behind the frame in such a manner that a locking connection is formed by the complementary mating of the locking projections of the frame with the locking recesses of the assembly unit and the locking projections of the assembly unit with the locking recesses of the frame, such that the locking connection holds the cooking surface clamped and sealed between the frame and the assembly unit;

the second end of the locking projection separated from the work plate by a second distance less than the first distance, thereby preventing the locking projection from being deflected from the edge of the assembly unit when the sub-assembly of the frame and the assembly unit are installed in the cut-out in the work plate.

2. The mounting arrangement according to claim 1, wherein the assembly unit includes a receptacle for housing a heating element and the frame includes a cross-piece which overlaps an area near an edge of the cooking surface so that the cross-piece forms a downwardly oriented leg that is supported on the cooking surface.

3. The mounting arrangement according to claim 2, further comprising a support part connected to the cross-piece of the frame, wherein the support part is placed on a top surface of the work plate to keep the cross-piece at a distance from the top surface of the work plate so that an adhesion layer, applied to an area between the cross-piece and the work plate, fixes the cross-piece to the work plate.

4. The mounting arrangement according to claim 1, wherein the frame includes a receptacle into which the cooking surface is positioned.

5. The mounting arrangement according to claim 1, wherein the assembly unit includes fastening parts on which heating elements are supported by springs so that when the frame is engaged with the assembly unit, the springs extend outwardly.

6. The mounting arrangement according to claim 5, wherein the frame and the assembly unit are made of any one of the group consisting of duroplastic, thermoplastic, and plastic composite material.

* * * * *